US005873944A

United States Patent [19]

Lien et al.

[11] Patent Number: 5,873,944

[45] Date of Patent: Feb. 23, 1999

[54] VACUUM WASTE PIPE CLEANING

[75] Inventors: Patrick Eugene Lien, Virginia Beach, Va.; Jerome H. Ludwig, Paradise Valley, Ariz.

[73] Assignee: H.E.R.C. Products Incorporated, Phoenix, Ariz.

[21] Appl. No.: 854,929

[22] Filed: May 13, 1997

[51] Int. Cl.[6] ..... B08B 5/04; B08B 7/04; B08B 9/03; B08B 9/06

[52] U.S. Cl. ..... 134/10; 134/21; 134/22.11; 134/22.12; 134/22.13; 134/169 R; 134/169 C; 134/171

[58] Field of Search ..... 134/10, 22.11, 134/22.12, 22.13, 22.16, 21, 24, 169 R, 169 C, 171; 4/321, 431

[56] References Cited

U.S. PATENT DOCUMENTS

| | | | |
|---|---|---|---|
| 2,758,970 | 8/1956 | Saukaitis et al. | 252/8.55 |
| 2,807,585 | 9/1957 | Gardner et al. | 252/148 |
| 2,941,949 | 6/1960 | Saukaitis | 252/151 |
| 3,077,454 | 2/1963 | Monroe et al. | 252/148 |
| 3,607,781 | 9/1971 | Kaneko et al. | 252/389 |
| 3,668,137 | 6/1972 | Gardner | 252/149 |
| 3,885,913 | 5/1975 | Redmore et al. | 21/2.7 |
| 4,025,360 | 5/1977 | Horne et al. | 134/169 R |
| 4,089,895 | 5/1978 | Bailey et al. | 252/135 |
| 4,115,876 | 9/1978 | Cole, Jr. et al. | 4/321 |
| 4,199,469 | 4/1980 | Walzer | 252/146 |
| 4,214,324 | 7/1980 | Kemper et al. | 4/321 |
| 4,310,435 | 1/1982 | Frenier | 252/180 |
| 4,357,719 | 11/1982 | Badger et al. | 4/431 |
| 4,521,925 | 6/1985 | Chen et al. | 4/321 |
| 4,541,945 | 9/1985 | Anderson et al. | 252/149 |
| 4,554,090 | 11/1985 | Jones | 252/181 |
| 4,587,030 | 5/1986 | Casey | 252/92 |
| 4,614,600 | 9/1986 | Schilling et al. | 252/8.553 |
| 4,637,899 | 1/1987 | Kennedy, Jr. | 252/542 |
| 4,670,189 | 6/1987 | Tomibe et al. | 252/514 |
| 4,780,150 | 10/1988 | Anderson et al. | 134/3 |
| 4,851,149 | 7/1989 | Carandang | 252/147 |
| 4,905,325 | 3/1990 | Colditz | 4/321 |
| 5,322,635 | 6/1994 | Hieatt et al. | 252/82 |
| 5,360,488 | 11/1994 | Hieatt et al. | 134/22.11 |
| 5,451,335 | 9/1995 | Hieatt et al. | 252/82 |
| 5,680,877 | 10/1997 | Edstrand et al. | 134/169 C |
| 5,707,027 | 1/1998 | Hiesener | 4/321 |

*Primary Examiner*—Jill Warden
*Assistant Examiner*—Saeed Chaudhry
*Attorney, Agent, or Firm*—Wood, Herron & Evans, L.L.P

[57] ABSTRACT

A method of and system for removing blockage from pipes in vacuum waste systems in which fouled pipes in the existing vacuum waste system are configured into a closed loop. A cleaning solution is added to the loop. The cleaning solution is recirculated through the loop by pumping it to the ends of the fouled pipes and drawing it through the fouled pipes using the existing system vacuum equipment. The vacuum waste system may remain operational during cleaning.

35 Claims, 2 Drawing Sheets

VACUUM WASTE PIPE CLEANING

FIELD OF THE INVENTION

This invention relates to a method of and apparatus for removing scale from pipes in vacuum waste systems.

BACKGROUND OF THE INVENTION

Vacuum waste systems are used aboard ships, aircraft, trains, in prisons and in high use public facilities not adequately served by traditional waste systems. Vacuum systems reduce the physical amount of waste generated and conserve the limited storage and on-board treatment capacity in these environments.

Vacuum systems have several advantages over traditional sewer systems. One advantage is that typical vacuum systems use less water per flush (approximately one pint versus one-and-one-half to three gallons in traditional systems). Another advantage is that the vacuum system pipes are not restricted to a linear, horizontal configuration since it is vacuum (typically 12–16 inches Hg at 25 feet/second) rather than gravity that is used to convey waste to a holding tank. This feature permits vacuum pipes to include bends, turns, and vertical sections. In turn, this allows the network of pipes to conform to the layout of the vehicle, rather than the vehicle having to conform to the layout of the waste system.

A major disadvantage of typical vacuum systems, however, is that the bends, turns, and vertical sections of the pipes accumulate scale faster than linear or horizontal pipe sections. This presents a confounding maintenance problem after even moderate periods of use. As waste is pulled through the pipe, it causes a sheeting action of water/suspended solids to form along the pipe walls due to surface tension. Even though the solenoid valves at each toilet/urinal are only open for one to two seconds, the resulting air flow is significant enough to evaporate most of the liquid clinging to the pipe walls or bends. The result is formation of an evaporative scale composed of mineral content, primarily in the form of calcium and magnesium carbonate, from the source water and any dissolved mineral content of the waste. Additionally, a portion of the macerated biological solids that were suspended in the wastewater also accumulates on the evaporative scale, thus binding the scale together and on the pipe walls. Vacuum leaks at joints, plugs, or diaphragm valves result in accelerated scale accumulation due to increased and often continuous air flow through the pipe.

Traditional means of cleaning vacuum waste pipe systems, such as hydroblasting with high pressure water or mechanical cleaning with "snakes" or augers, are difficult and are not completely satisfactory.

While hydroblasting can remove loose debris, its disadvantages are that it only works with straight pipe runs, the waste water has to be removed at an outlet other than the access point, it is a lengthy and messy process, and substantial amounts of hard scale still remain on the pipe walls. Mechanical cleaning removes only the very loose debris in the center of the pipe without removing any of the very hard scale that significantly reduces the carrying capacity of the pipes. An additional disadvantage of both hydroblasting and mechanical cleaning means is that both require almost complete dismantling of the system to create access for cleaning and extended periods of down time for the system.

SUMMARY OF THE INVENTION

The invention is an improvement over the prior art in several respects. In this invention, pipes that include bends, turns, and vertical sections are cleaned as effectively as linear or horizontal pipes. The system is self-contained and only a single set up and tear down of the system is required. Additionally, at least a portion of the toilets/urinals can remain operational throughout the cleaning process, and the system can usually be cleaned in an eight hour period or less.

An existing vacuum waste pipe system is configured into a closed loop. A cleaning solution is added to the loop and is circulated throughout the loop. The existing vacuum in the system is used to draw the cleaning solution from the toilets/urinals to a source distal to the vacuum source and tank, such as the system holding tank or waste discharge point. From there, the cleaning solution is pumped to the terminal pipes of the system to complete the loop.

In a preferred embodiment, an existing system pump is used to pump the cleaning solution. In another preferred embodiment, a cleaning solution is introduced from a mobile unit to a manifold. In still another preferred embodiment, inflatable plugs are placed in the most remote toilets/urinals to prevent backflow during the cleaning process.

The objectives and other advantages of this invention will be further understood with reference to the following drawings and detailed description.

DETAILED DESCRIPTION

Figures 1, 2, 5:
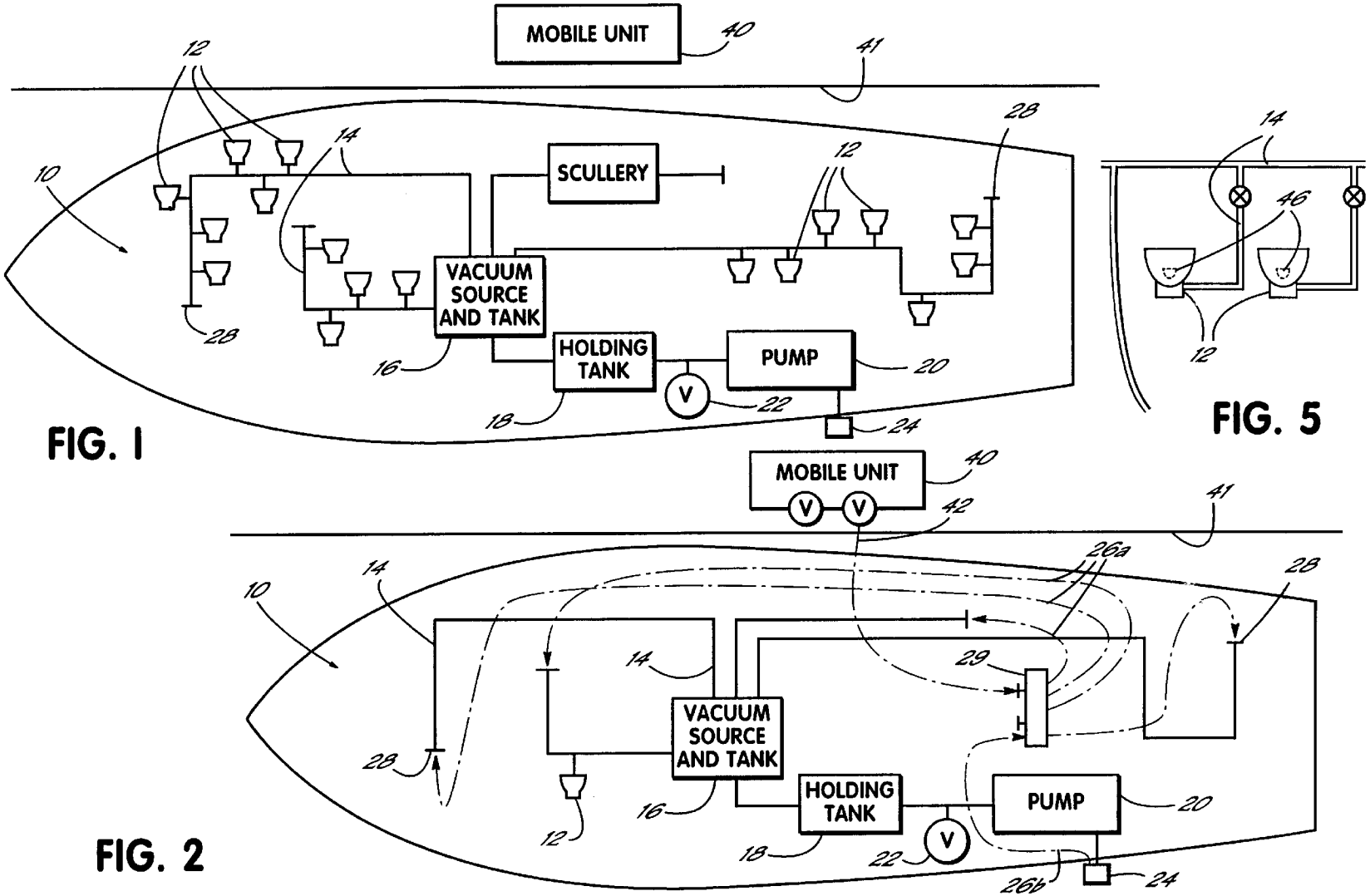
FIG. 1 is a schematic of a shipboard configuration of a vacuum waste pipe system.
FIG. 2 is a schematic of the vacuum waste pipe system of FIG. 1 configured for cleaning according to a presently preferred embodiment of the invention.
FIG. 5 is a schematic of individual toilets/urinals connected to the vacuum waste pipe system of FIG. 2 configured for cleaning.

With reference to FIG. 1, an existing vacuum waste system 10 contains a plurality of waste sources such as toilets/urinals 12 connected by a plurality of pipes 14. A pipe is defined to include the pipe itself and all associated conduits, elbows, T-couplings, and valves. A vacuum source and tank 16 supplies vacuum for the pipe contents to be drawn through the pipes 14 into a holding tank 18. Waste is stored in the holding tank 18 until discharged from the system 10. Waste is discharged by using a pump 20 and opening a valve 22 between the pump 20 and the holding tank 18 to pump the waste out at a waste discharge point 24.

With reference to FIG. 2, pipes 14 that are fouled by waste are cleaned by the method of this invention by configuring the existing vacuum waste system 10 into a closed loop. A plurality of hoses 26*a* connect the pipe ends 28 to a manifold 29. A discharge hose 26*b* connects the manifold 29 to the waste discharge point 24. The hoses 26*a–b* are preferentially made of canvas jacketed rubber or a polyethylene composite that is not affected by low concentrations of acidic, basic or other cleaning agents. The hose couplings are preferably threaded brass, which is less prone to pitting or corrosion than other materials. However, the hose couplings may be made of a high impact plastic such as polyvinyl chloride (PVC), or, for cleanings of short duration, an aluminum alloy such as Pyrolite.

Figure 3:
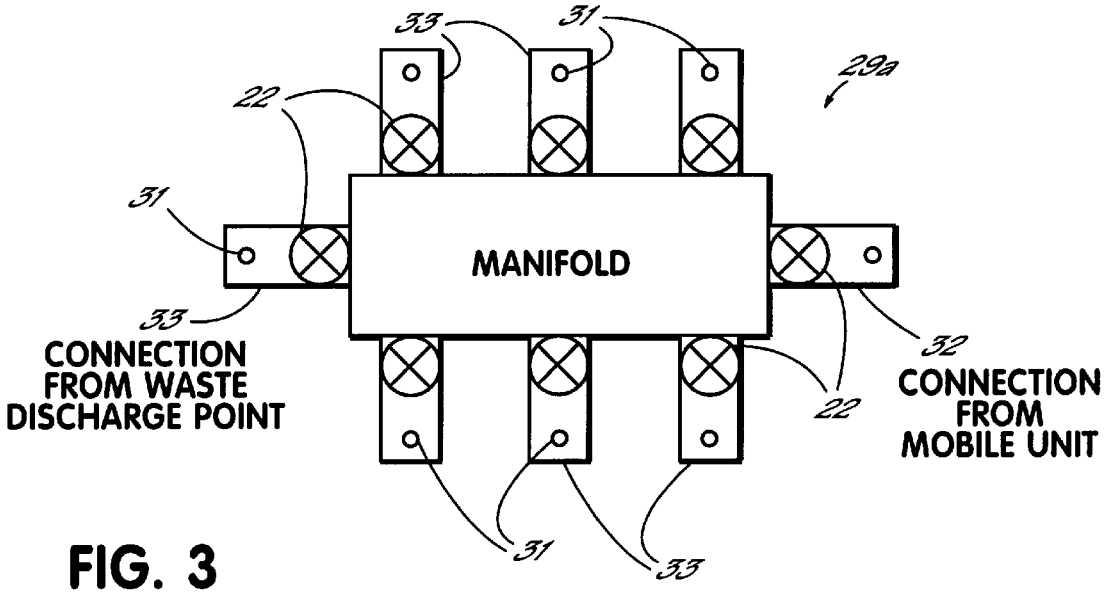
FIG. 3 is a schematic of a preferred manifold set up.

With reference to FIG. 3, a presently preferred embodiment of a manifold 29*a* has PVC couplings (schedule 80 threaded) and added valves 22 used at each outlet 33 to control flow direction, volume and pressure. Ideally, a pressure gauge 31 is attached to the inlet line 32 and to each outlet line 33.

Figure 4:
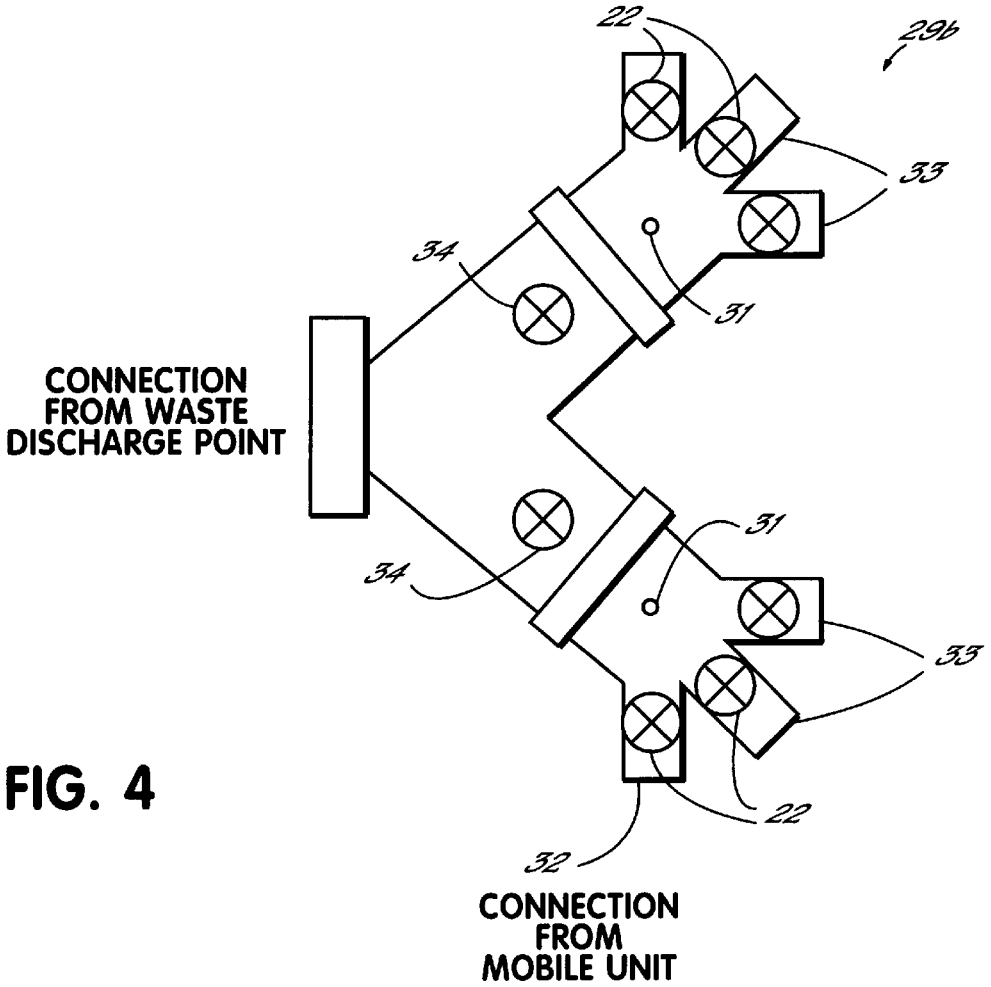
FIG. 4 is a schematic of an alternately preferred manifold set up.

With reference to FIG. 4, four inch gated "Y" valves 34 may also be used on an alternately preferred embodiment of a manifold 29*b* to increase the number of outlet lines 33 from the manifold 29*b* and to control pressure and flow to the ends of the system 28.

The integrity of the hoses 26*a–b* and their connections are tested by circulating water through the closed loop system without a cleaning agent added. Referring to FIG. 2, water is initially introduced from the manifold 29, through the hoses 26*a* and into the loop where it is circulated. Circulation is accomplished by pumping water to the ends of the pipes 28 in the system 10 using the pump 20. For example, the pump 20, which is normally connected to the holding tank 18 and used to discharge waste from a vessel, can be used to pump water or cleaning solution throughout the loop. Once the water is at the ends of the pipes 28 in the system 10, it is drawn through the pipes 14 and a source distal to the vacuum source and tank 16, such as the holding tank 18 or waste discharge point 24, using the existing vacuum in the system 10 provided by the vacuum source and tank 16. Pumping water back through the discharge hose 26*b* into the manifold 29 completes the closed loop.

A cleaning solution, preferably Pipe-Klean® Preblend, disclosed in U.S. Pat. No. 5,360,488 and hereby incorporated by reference, is then introduced into the closed loop system and is circulated throughout the loop. In one embodiment, a cleaning solution is contained in a mobile unit 40 located on a pier 41 adjacent the system and is introduced into the system 10 by a hose 42 connected to the mobile unit 40 at one end and to the on-site manifold 29 at the other end.

The mobile unit 40 is preferred for addition of cleaning solution for the following reasons: (1) it can provide the sufficiently large tank capacity required for most cleaning applications, (2) it can accommodate the size of hose required to provide sufficient pressure (normally up to 20 psi through a 2.5 inch hose with between ten and twenty feet of head), and (3) it facilitates diluting the cleaning solution to an appropriate concentration (normally 12.5%). Furthermore, the mobile unit 40 can be used as an alternate pumping source in circulating a cleaning solution if there is a problem with the pump 20 or the vacuum source and tank 16 in the system 10. One preferred embodiment of a mobile unit 40 is described in U.S. Pat. application Ser. No. 08/547,099, filed Oct. 23, 1995, which is assigned to the assignee of this invention and is hereby incorporated by reference. While a mobile unit 40 is preferred, an alternate source to introduce cleaning solution to the system may be used. The alternate source must be non-reactive with the cleaning solution, have a minimum tank capacity of about 1500 gallons, and have recirculating/mixing capabilities that can pump at pressures of 20 psi through 2.5 inch hoses. There must also be a means of gradually adding flow and pressure to the lines and also a means of quickly relieving that pressure.

The cleaning solution is circulated throughout the loop in the same way water is circulated. The cleaning solution is pumped to the ends of the pipes 28 in the system 10 using the pump 20. Once the cleaning solution is at the ends of the pipe 28 in the system 10, it is drawn through the pipes 14 using the existing vacuum in the system 10 provided by the vacuum source and tank 16.

An acidic cleaning solution may react with the scale and waste along the walls of the pipes 14 to generate carbon dioxide gas. Because gas buildup in the closed loop cleaning configuration can be dangerous, pressure in the loop is routinely monitored. Pressure can be monitored by either manual or automatic reading of the pressure gauges 31 in the manifold 29. The cleaning solution is circulated throughout the closed loop system until cleaning is complete. When cleaning is complete, carbon dioxide is no longer produced, since no scale or waste remains on the pipe walls to react with the cleaning solution to form carbon dioxide. Hence, the return of normal pressure within the loop signals that the system 10 has been cleaned.

At least a portion of the existing vacuum waste system 10 may remain operational throughout cleaning. The set-up process, during which the system is configured into a closed loop, does not interrupt normal use. The contents of the holding tank 18 are preferably emptied before cleaning commences. Water is circulated initially, as previously described. When cleaning solution is added, the vacuum source and tank 16 and pump 20 are operated manually. While it is important to create a positive flow through the partially clogged pipes and lines, it is also important to transmit less volume than what the pipes and lines may hydraulically be capable of transmitting. The cleaning solution is thus added initially at a rate of approximately five to ten gallons per minute. This produces a more consistent sheeting pattern on the available inner diameter of the pipe, which in turn allows for rapid carbon dioxide production and removal.

The spent cleaning solution is removed from the closed system by collecting it in the holding tank 18 until it is discharged using the pump 20 at the waste discharge point 24. The hoses 26*a–b* are then disconnected from the ends of the pipes 28, from the manifold 29, and from the waste discharge point 24.

With reference to FIG. 5, the toilets/urinals 12 may be fitted with inflatable plugs 46, available from Cherne Co., Minneapolis, Minn. The plugs 46 help to prevent backflow of cleaning solution from the toilets/urinals 12. Plugs 46 are especially useful in toilets/urinals 12 closest to ends of pipes 28, since vacuum is the lowest at the ends and also since these pipes 28 are likely to have accumulated the most scale and waste buildup due to static conditions at the ends 28. Overflow may result when the hoses 26*a–b* have a larger diameter than the existing system pipes 14, 28, and are able to provide more flow than the smaller partially blocked pipes can handle. Thus, the plugs 46 help to retain cleaning solution within the pipes 14, 28. The preferred plug 46 sizes are 1 ¼" and 1 ¾" and are easily inflated with a manual pump or compressed air.

Acid, alkaline or neutral cleaning solutions may be employed. Among the acidic cleaning solutions found to be useful in practicing the method of this invention are aqueous solutions of mineral acids such as hydrochloric, nitric, phosphoric, polyphosphoric, hydrofluoric, boric, sulfuric, sulfurous, and the like. Aqueous solutions of mono-, di- and polybasic organic acids have also been found to be useful and include formic, acetic, propionic, citric, glycolic, lactic, tartaric, polyacrylic, succinic, p-toleunesulfonic, and the like. The useful treatment solutions may also be aqueous mixtures of the above mineral and organic acids.

The acidic solution may also contain acid inhibitors which substantially reduce the acidic action on metal surfaces of the water distribution system, particularly valves, fire hydrants, etc., and these various inhibitors for acids have been well documented in the patent art. Typical, but not necessarily all inclusive, examples of acid inhibitors are disclosed in U.S. Pat. Nos. 2,758,970; 2,807,585; 2,941,949; 3,077,454; 3,607,781; 3,668,137; 3,885,913; 4,089,795; 4,199,469; 4,310,435; 4,541,945; 4,554,090; 4,587,030; 4,614,600; 4,637,899; 4,670,186; 4,780,150 and 4,851,149 which are incorporated herein by reference.

The treatment solution may also contain dispersing, penetrating or emulsifying agents to assist in the removal of the scale and sediment. These surface active agents may be anionic, cationic, nonionic or amphoteric as defined in the art. Compounds such as alkyl ether sulfates, alkyl or aryl sulfates, alkanolamines, ethoxylated alkanolamides, amine oxides, ammonium and alkali soaps, betaines, hydrotropes such as sodium aryl sulfonates, ethoxylated and propoxylated alkylphenols, sulfonates, phosphate esters, quarternaries, sulfosuccinates, and mixtures thereof, have been found to be useful in admixture with the acid treating solution.

Alkali metal hydroxide solutions such as 25% sodium hydroxide have been found useful in removal of vacuum waste blockages. The caustic attacks the residual waste mass binding the evaporative scale, digesting it and thus allowing the evaporative scale to be released from the blockage and flushed from the system. Ammonia gas is usually released upon digestion of the binding waste mass.

Sequestering or chelating agents such as EDTA (ethylenediamine tetraacetic acid), NTA (nitrilotriacetic acid), and derivatives, i.e., basic alkali salts, and the like have also been found to be useful in the treatment solution in certain cases.

Neutral compositions such as those described in U.S. Pat. Nos. 5,322,635 and 5,451,335, which are assigned to the assignee of this invention and are hereby incorporated by reference, have also been found useful in removing vacuum waste blockages.

Other variations or embodiments of this invention will become apparent to one of ordinary skill in the art in view of the above description, and the foregoing embodiments are not to be construed as limiting the scope of this invention.

What is claimed is:

1. A method of cleaning a fouled pipe in a vacuum waste system, comprising:

configuring the system into a closed loop having at least one fouled pipe for cleaning by using connectors between (a) an end of the fouled pipe and a manifold, (b) the manifold and a pump and (c) the pump and a source distal to a vacuum source;

operatively connecting the vacuum source to the closed loop;

operatively connecting the pump to the closed loop;

adding a cleaning solution to the manifold in the closed loop;

circulating the cleaning solution through the pipe in the closed loop by using the operatively connected vacuum source and the operatively connected pump; and removing a spent cleaning solution from the loop.

2. The method of claim 1 wherein the connectors between the end of the pipe and the manifold, and the manifold and the pump comprise a plurality of hoses.

3. The method of claim 1 wherein the source distal to a vacuum source is selected from the group consisting of a holding tank and a waste discharge point.

4. The method of claim 1 wherein the system remains at least in part operational during the cleaning.

5. The method of claim 1 wherein a mobile unit initially contains the cleaning solution to be introduced into the system.

6. The method of claim 5 wherein a hose connected from the mobile unit to a manifold introduces the cleaning solution into the manifold.

7. The method of claim 1 wherein waste from the vacuum system is discharged prior to cleaning the system.

8. The method of claim 1 wherein the cleaning solution is selected from the group consisting of:

an acidic cleaning solution;

a basic cleaning solution; and a neutral cleaning solution.

9. The method of claim 8 wherein the cleaning solution is caustic.

10. The method of claim 9 wherein the caustic cleaning solution is used to remove carbonate-containing residual biomass.

11. The method of claim 9 wherein the caustic cleaning solution is an alkali metal hydroxide solution.

12. A method of cleaning a fouled pipe in a vacuum waste system, comprising:

removing an existing waste from the system;

configuring the system into a closed loop by using connectors between (a) an end of the fouled pipe and a manifold, (b) the manifold and a pump and (c) the pump and a source distal to a vacuum source;

installing an inflatable plug into a selected waste source to prevent backflow in the source;

connecting a hose from a mobile unit containing water to a manifold operatively connected to the system to introduce the water into the loop;

circulating the water through the loop to test the integrity of the loop by pumping the water from the manifold to at least one pipe end using an operatively connected pump of the vacuum waste system, and drawing the water from the pipe end through the pipe using an operatively connected vacuum source of the vacuum waste system;

adding a cleaning solution to the water in the mobile unit to introduce the cleaning solution into the loop;

circulating the cleaning solution through the loop to clean the pipes by pumping the cleaning solution from the manifold to the pipe end using the pump and drawing the cleaning solution from the pipe end through the pipe using the vacuum source; and discharging a spent cleaning solution from the system.

13. The method of claim 12 wherein the connectors between the end of the pipe and the manifold, and the manifold and the pump comprise a plurality of hoses.

14. The method of claim 13 conducted at water pressures of about five to about fifteen pounds per square inch pressure.

15. The method of claim 12 conducted at water pressure of about five to about fifteen pounds per square inch pressure.

16. The method of claim 12 wherein the plug is installed into a terminal waste source to prevent backflow.

17. The method of claim 12 wherein the spent cleaning solution is discharged to one of a waste discharge point on a vessel containing the vacuum waste system and the mobile unit.

18. The method of claim 12 further comprising monitoring a pressure within the system pipe to prevent pressure buildup in the closed loop, the pressure being generated from a reaction between the cleaning solution and scale in the system pipe.

19. The method of claim 12 wherein the acidic cleaning solution is added initially at a rate of about five to about ten gallons per minute to prevent pressure buildup.

20. The method of claim 12 further comprising manually regulating the pump.

21. The method of claim 12 wherein the system is located on one of the following: a ship, a train, and an aircraft.

22. The method of claim 12 wherein the cleaning solution is selected from the group consisting of:

an acidic cleaning solution;

a basic cleaning solution; and a neutral cleaning solution.

23. The method of claim 22 wherein the cleaning solution is caustic.

24. The method of claim 23 wherein the caustic cleaning solution is used to remove carbonate-containing residual biomass.

25. The method of claim 23 wherein the caustic cleaning solution is an alkali metal hydroxide solution.

26. A cleaning system for cleaning a fouled pipe in a vacuum waste system, the pipe having a first end connected to a vacuum source and a second terminal end, the cleaning system comprising:

a manifold for containing the cleaning fluid;

a pump for pumping the cleaning fluid to the terminal pipe end;

a vacuum source for drawing the cleaning fluid through the pipe; and a connector for connecting the manifold and the terminal pipe end; wherein the cleaning system forms a closed loop.

27. The cleaning system of claim 26 wherein a plurality of connectors connect the manifold to a plurality of pipe ends, the connectors comprising:

a discharge hose for connecting the manifold and the pump; and a plurality of hoses for connecting the plurality of pipe ends and the manifold, so that the pipes are cleaned by circulating a cleaning solution in the closed loop through the plurality of hoses, the plurality of pipes, the vacuum source, the pump, the discharge hose and the manifold.

28. The cleaning system of claim 27 wherein the manifold, discharge hose, and plurality of hoses are selectively connected and disconnected from the vacuum waste system.

29. The cleaning system of claim 26 wherein a plurality of waste sources are operatively connected to the pipes, the cleaning system further comprising:

an inflatable plug adapted to be inserted into selected ones of the plurality of waste sources to prevent backflow in the system during cleaning.

30. The cleaning system of claim 26 further comprising:

a mobile unit operatively connected to the manifold to introduce the cleaning solution into the cleaning system.

31. The cleaning system of claim 26 wherein the manifold is an intermediate vessel for receiving a cleaning solution from a mobile unit.

32. A vacuum waste system comprising:

a vacuum source;

a holding tank connected to the vacuum source;

a pump connected to the holding tank;

a system of waste pipes including at least one branch having a first end connected to the vacuum source and a second terminal end;

at least one waste source connected to the branch;

a manifold connected to the pump;

a hose connected to the terminal end of the branch and the manifold; and a cleaning solution in the vacuum waste system so that when the pump and vacuum source are operational, the cleaning solution is distributed through the manifold and the hose to the system of waste pipes and the holding tank in a closed loop path to thereby clean the vacuum waste system.

33. The system of claim 32 further comprising an inflatable plug selectively inserted into selected ones of the at least one waste source to thereby prevent backflow of the cleaning solution.

34. The system of claim 32 further comprising a mobile unit connected to the manifold for introducing the cleaning solution into the vacuum waste system.

35. The system of claim 32 wherein at least one waste source is a toilet/urinal and the vacuum waste system is located on one of the following: a ship, a train and an aircraft.

* * * * *